US006926163B2

(12) United States Patent
Darr et al.

(10) Patent No.: US 6,926,163 B2
(45) Date of Patent: Aug. 9, 2005

(54) PLASTIC CONTAINER AND SEPARATELY FORMED HANDLE

(75) Inventors: Richard C. Darr, Medina, OH (US); James J. Miller, Barberton, OH (US); Richard A. Lovelace, Jr., Akron, OH (US); Thomas J. Simpson, Marshallville, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 5 days.

(21) Appl. No.: 10/762,778

(22) Filed: Jan. 22, 2004

(65) Prior Publication Data

US 2005/0082251 A1 Apr. 21, 2005

Related U.S. Application Data

(63) Continuation-in-part of application No. 29/191,870, filed on Oct. 15, 2003, now Pat. No. Des. 496,584.

(51) Int. Cl.[7] ..... B65D 23/10

(52) U.S. Cl. ..... 215/396; 215/373; 220/758; 220/769

(58) Field of Search ..... 215/372, 373, 215/383, 396, 398; 220/758, 759, 769; 294/28, 294/33

(56) References Cited

U.S. PATENT DOCUMENTS

| | | | | |
|---|---|---|---|---|
| 2,610,081 | A * | 9/1952 | Bushman | 294/28 |
| 4,108,324 | A * | 8/1978 | Krishnakumar et al. | 215/373 |
| 4,273,246 | A * | 6/1981 | Thompson | 215/398 |
| 4,768,403 | A * | 9/1988 | Bar-Noy | 81/3.15 |
| 4,964,522 | A * | 10/1990 | Umetsu et al. | 215/398 |
| 5,064,081 | A * | 11/1991 | Hayashi et al. | 215/373 |
| 5,297,686 | A * | 3/1994 | Takeuchi | 215/396 |
| 5,833,115 | A * | 11/1998 | Eiten | 220/669 |
| 5,908,127 | A * | 6/1999 | Weick et al. | 215/373 |
| 6,378,924 | B1 * | 4/2002 | McCrumb | 294/28 |
| 6,588,623 | B2 * | 7/2003 | Falcaro | 220/758 |

* cited by examiner

*Primary Examiner*—Sue A. Weaver
(74) *Attorney, Agent, or Firm*—Robert H. Bachman

(57) ABSTRACT

The container includes a hollow body of plastic material having a lower supporting base, a sidewall extending upwardly from the base, a shoulder portion extending upwardly from the sidewall and an upper neck portion with an opening therein extending upwardly from the shoulder portion. The neck portion includes at least one engagement surface which fits together with at least one engagement surface on a separately formed handle to form at least one projection seated in at least one groove.

17 Claims, 9 Drawing Sheets

PLASTIC CONTAINER AND SEPARATELY FORMED HANDLE

CROSS-REFERENCE TO RELATED APPLICATIONS

This application is a continuation-in-part of U.S. patent application Ser. No. 29/191,870 for HANDLE FOR CONTAINER, filed Oct. 15, 2003 now U.S. Pat. No. D.496,584.

BACKGROUND OF THE INVENTION

Plastic containers, especially in larger sizes, are often formed with an integral handle. These are generally formed by a stretch blow molding procedure, which is well known.

However, the integral handle configuration complicates the stretch blow molding process. It would be highly desirable to provide a container configuration which can be formed without an integral handle, and separately form a handle for subsequent attachment to the container. Moreover, this should be accomplished in a simple and convenient way with a firm engagement between the separately formed handle component and the separately formed container component. The resulting product should be esthetically pleasing and easy to use by the consumer.

In addition, it is desirable to provide a lightweight, plastic container suitable for preparation by stretch blow molding and which permits rigidity while pouring, together with a firm, separately formed handle component. The lightweight container should desirably have good top load characteristics and good bulge resistance.

Accordingly, it is an objective of the present invention to provide an improved plastic container with a separately formed handle wherein the container portion can be conveniently prepared by stretch blow molding.

It is a further objective of the present invention to provide a container as aforesaid where the separately formed handle is firmly engaged with the container and is easy to use by the consumer.

It is a still further object of the present invention to provide a container as aforesaid which is lightweight and has good product characteristics.

Further objects and advantages of the present invention will appear hereinbelow.

SUMMARY OF THE PRESENT INVENTION

In accordance with the present invention the foregoing objects and advantages are readily obtained.

The plastic container of the present invention with a separately formed handle comprises: a hollow body of plastic material having a lower supporting base, a sidewall extending upwardly from the base, a shoulder portion extending upwardly from the sidewall, and an upper neck portion with an opening therein extending upwardly from the shoulder portion; a separately formed handle having an annular portion engaging said neck portion and supported thereby and a handle portion extending downwardly from the annular portion; wherein said neck portion and annular portion each include at least one engagement surface which fit together to form at least one projection seated in at least one groove. Preferably, the annular portion of the handle includes at least one inwardly extending groove and the neck portion includes at least one outwardly extending projection seated therein. Desirably, a plurality of said projections and engaged grooves are spaced around the circumference of the neck portion and annular portion, respectively.

The plastic container of the present invention which accommodates a separately formed handle, comprising: a hollow body of plastic material having a lower supporting base, a sidewall extending upwardly from the base, a shoulder portion extending upwardly from the sidewall, and an upper neck portion with an opening therein extending upwardly from the shoulder portion; wherein said neck portion includes at least one engagement surface which fits together with at least one engagement surface on a separately formed handle to form at least one projection seated in at least one groove.

The present invention also includes a handle, preferably plastic, configured to be attached to a separately formed container. The handle comprises: a first open position and a second closed position; said first open position having semi-circular central portions connected by a hinge, wherein at least one engagement surface is provided on the semi-circular portions configured to engage at least one engagement surface on the separately formed container to form at least one projection seated in at least one groove; said second closed position having said semi-circular portions closed to form an annular portion configured to engage the neck portion of the separately formed container with the engagement surfaces fitted together, and having a handle portion extending from said annular portion.

The first open position preferably includes two arm portions extending outwardly from the semi-circular portions, and said second closed position includes said two arm portions connected together to form a handle portion.

Further features of the present invention will appear hereinbelow.

BRIEF DESCRIPTION OF THE DRAWINGS

The present invention will be more readily understandable from the accompanying exemplificative drawings, wherein.

DETAILED DESCRIPTION OF PREFERRED EMBODIMENTS

Figure 1:
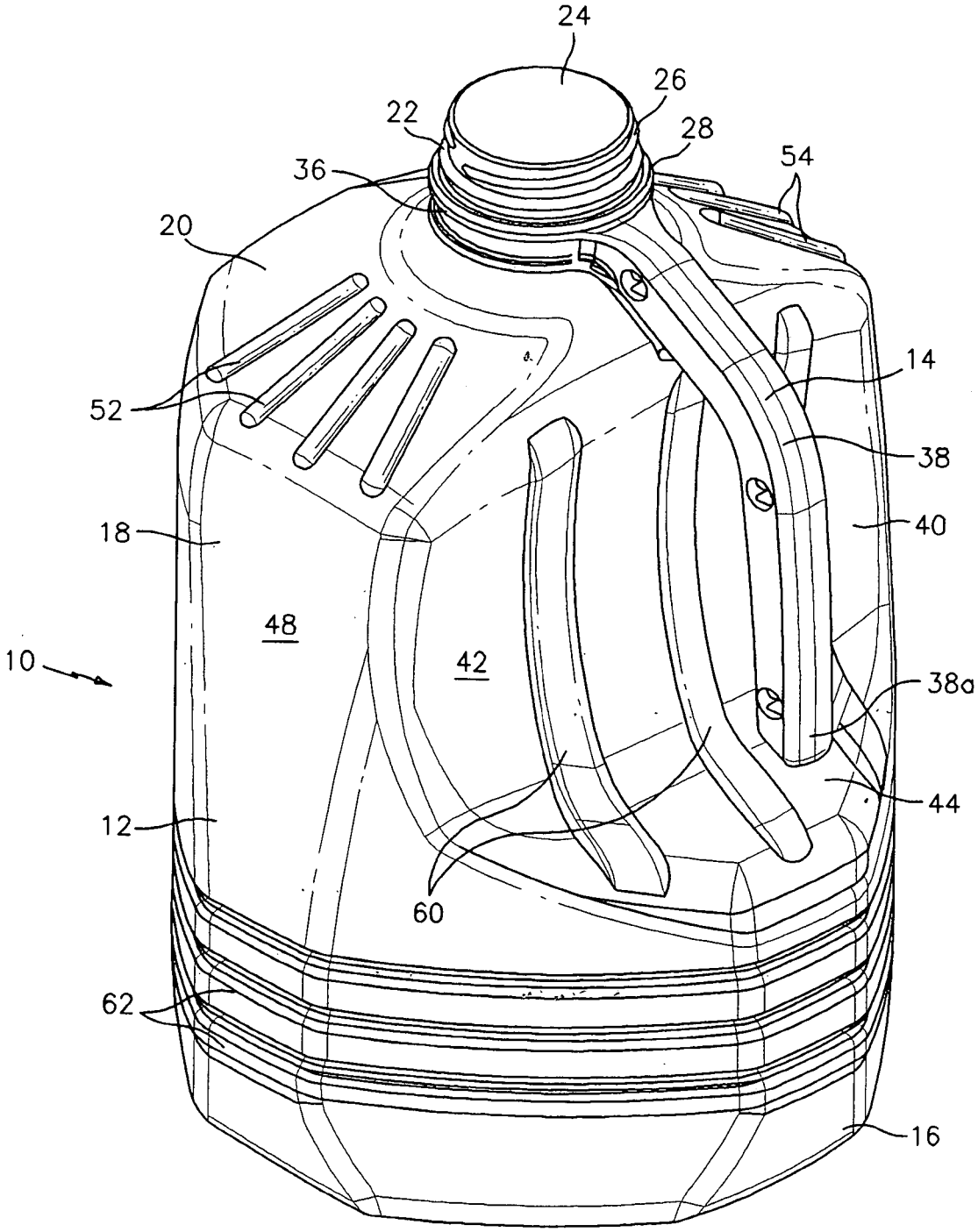
FIG. 1 is a perspective view of the container with handle attached thereto showing the rear and right side thereof.
Figure 2:
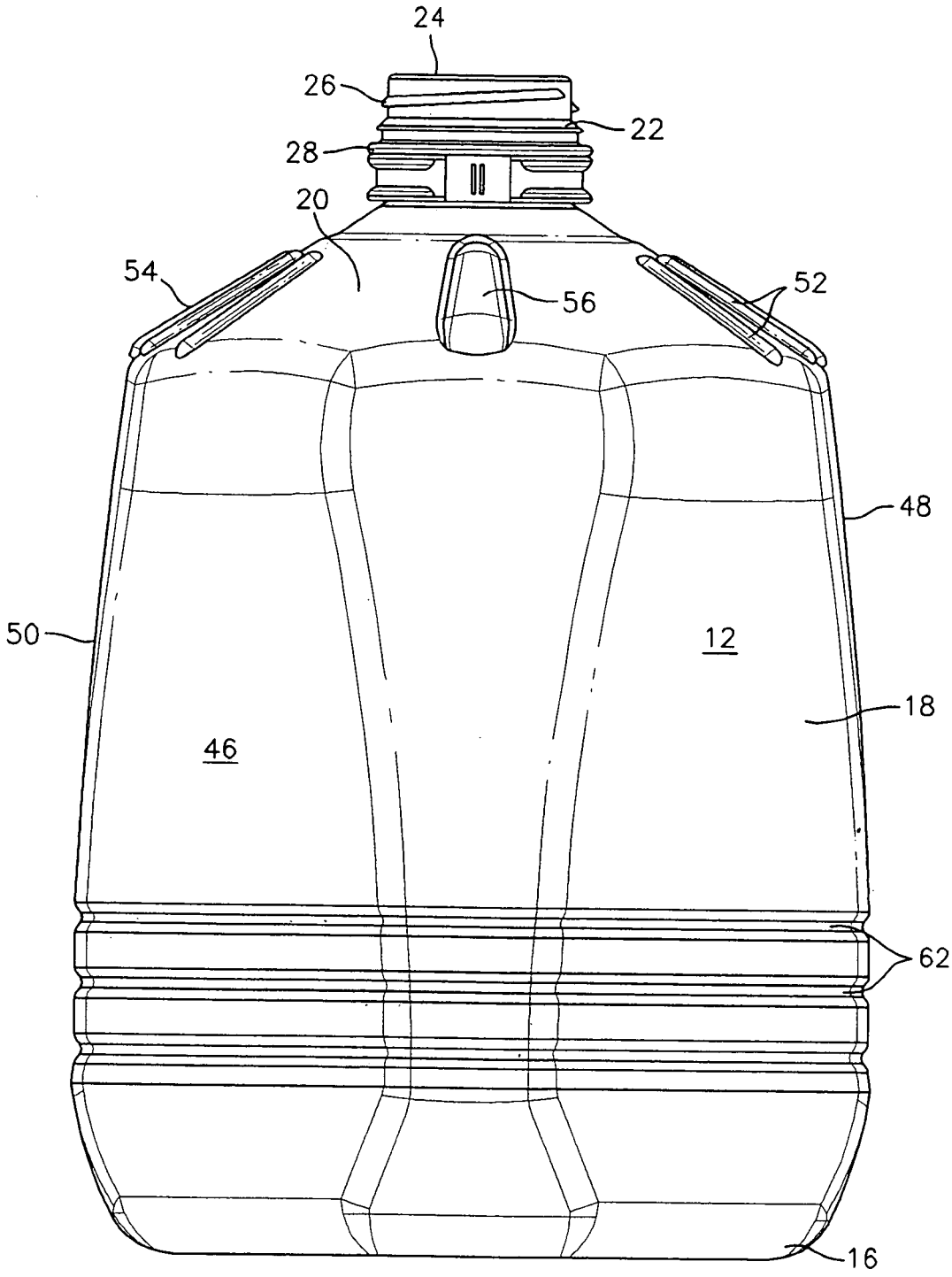
FIG. 2 is a front view of the container with handle of FIG. 1.
Figure 3:
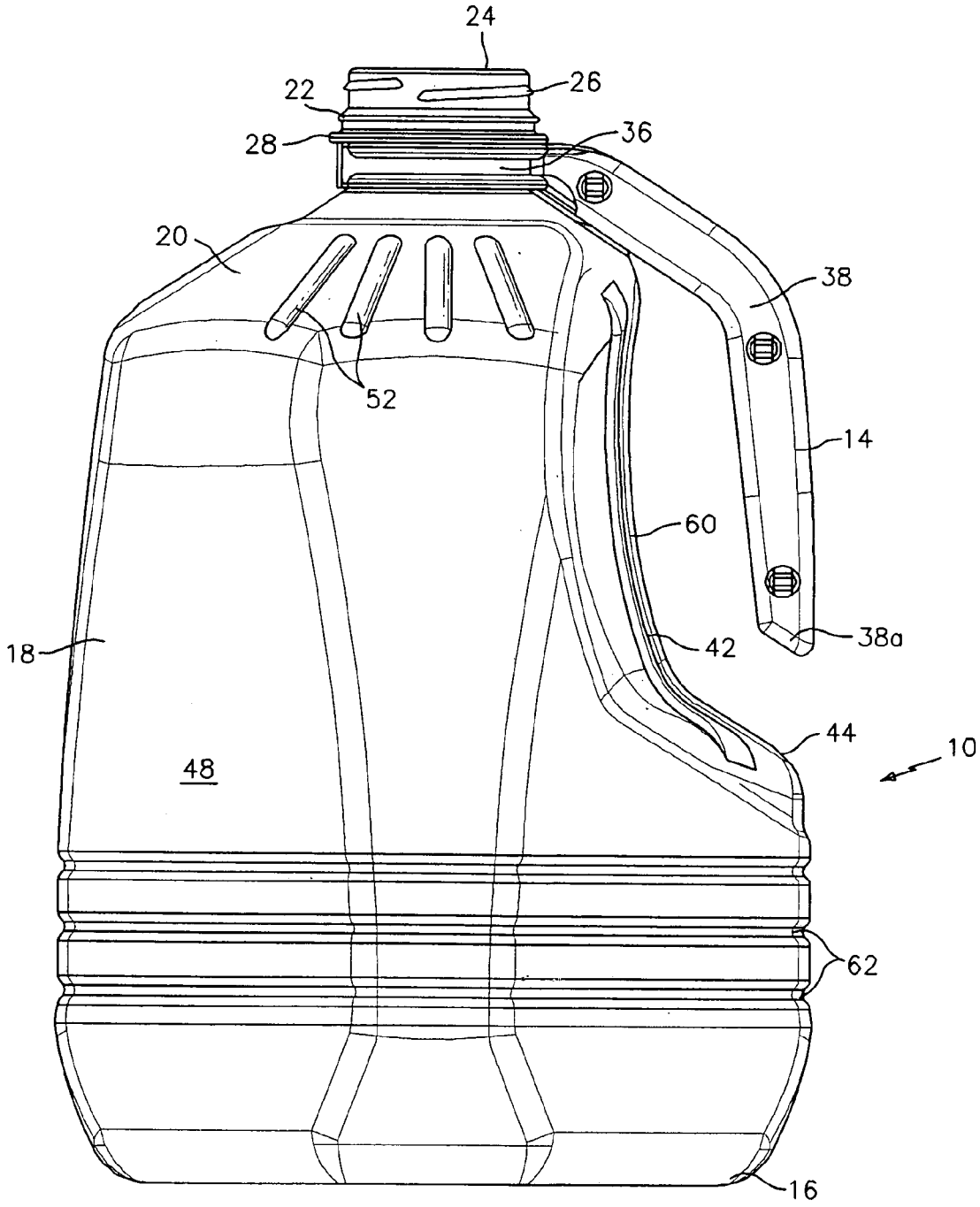
FIG. 3 is a right side view of the container with handle of FIG. 1.

Referring to the drawings, FIGS. 1–3 show one embodiment of the plastic container 10 of the present invention with container portion 12 and separately formed handle 14 attached thereto.

The container 10 is a hollow, blow molded container having a lower supporting base 16, a sidewall 18 extending upwardly from the base 16, a gradually inclined shoulder portion 20 extending upwardly from the sidewall 18, and an upper neck portion 22 with an opening 24 therein to the inside of the container extending upwardly from the shoulder portion 20.

The containers are preferably made of a pliable, deformable synthetic polymeric material, such as polyethylene, polypropylene, or polyethylene terephthalate (PET), or other plastic material, although PET is generally used. The embodiment shown in the drawings herein is a one gallon container which is a preferred embodiment. However, the present invention can be effectively employed for any plastic container, particularly where an integral handle is used.

The neck portion 22 includes a threaded upper section 26 with an outwardly extending rim 28 circumscribing the neck portion 22 below the threaded section 26 to accommodate a screw-on closure, although other type neck finishes can be employed, such as those to accommodate a foil closure or a snap on closure.

Figure 4:
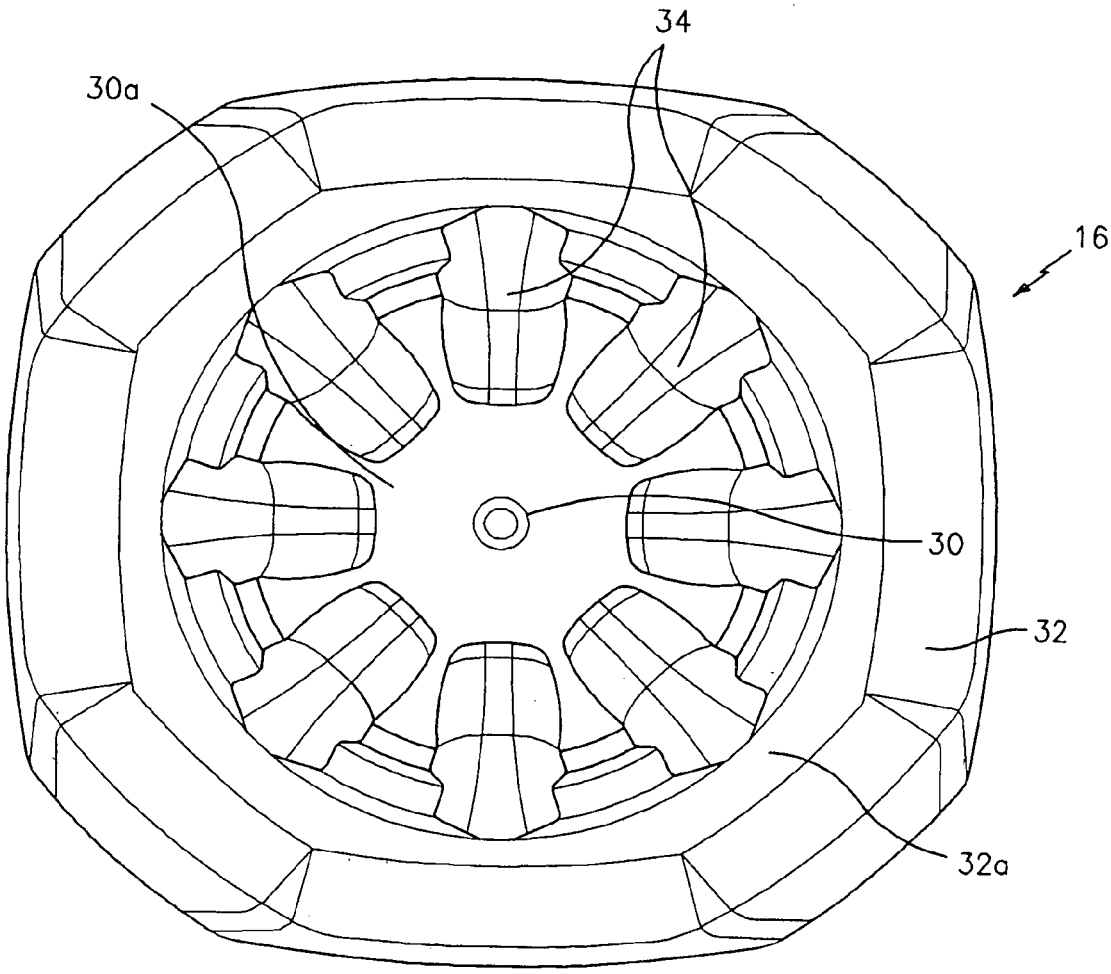
FIG. 4 is a view of the base of the container of FIG. 1.

An exemplificative base 16 is shown in FIG. 4. Base 16 desirably includes a central, inwardly extending recessed area 30, a peripheral rim 32, and a plurality of outwardly extending struts or ribs 34 having a curved cross-section. In the embodiment of FIG. 4 eight struts 34 surround inwardly extending recessed area 30 and extend between the outer portion 30*a* of the recessed area 30 and the inner portion 32*a* of the peripheral rim 32. The peripheral rim, which circumscribes the base 16, provides stability to the container when the container is standing. Naturally, other base configurations can be employed.

Handle 14 includes an upper annular portion 36 which at least in part surrounds and engages neck portion 22 below outward rim 28, and a handle portion 38 connected to said annular portion 36 and extending generally downwardly therefrom. Handle 14 will be discussed in more detail hereinbelow.

One side of container 10, the rear sidewall 40 adjacent handle 14, includes an inwardly curved portion 42 which extends part way down rear sidewall 40 and ends above base 16 in an outwardly extending ridge 44. Downwardly extending handle portion 38 extends adjacent the inwardly curved portion 42 to create a fairly symmetrical container as seen in FIG. 3, and end portion 38*a* of handle portion 38 is spaced above ridge 44.

The embodiment shown in FIGS. 1–3 is a lightweight, one gallon PET container prepared by reheat stretch blow molding in a conventional blow molding apparatus. Due to the smaller configuration of the container portion 12, which is blow molded without an attached handle, advantageously a larger number of these containers can be formed in each blow molding cycle.

Sidewall 18 of container portion 12 includes rear sidewall 40, front sidewall 46, right sidewall 48, and left sidewall 50. The left and right sidewalls are essentially the same. Shoulder 20 preferably includes a plurality of elongated, longitudinally extending ribs. In the embodiment of FIGS. 1–3, shoulder 20 includes four spaced apart elongated, longitudinal, outwardly extending right side shoulder ribs 52 above right sidewall 48, and four corresponding left side shoulder ribs 54 above left sidewall 50. In addition, a further elongated, longitudinal, outwardly extending front shoulder rib 56 extends above front sidewall 46, and a further elongated, longitudinal, outwardly extending rear shoulder rib 58 (seen in FIG. 5) extends above rear sidewall 40. As can be seen, in this embodiment the front and rear shoulder ribs are wider than the side shoulder ribs. One can vary the number, shape and disposition of the shoulder ribs, with the embodiment shown herein being a preferred embodiment. Advantageously, the shoulder ribs aid in rigidity while pouring and improve top load resistance in the shoulder area of the container.

Inwardly curved portion 42 includes at least one and generally a plurality, three are shown, of longitudinal, outwardly extending ribs 60 which are spaced apart and which run essentially the entire length of curved portion 42 under handle portion 38. These serve to improve top load and bulge resistance of the container after the container is filled. Here again, one can vary the size, shape and disposition of these ribs.

Sidewall 18 between base 16 and curved portion 42 includes at least one and preferably a plurality of inwardly extending, spaced apart ribs 62 which preferably, circumscribe the sidewall. Three are shown in the embodiment of FIGS. 1–3.

Figure 5:
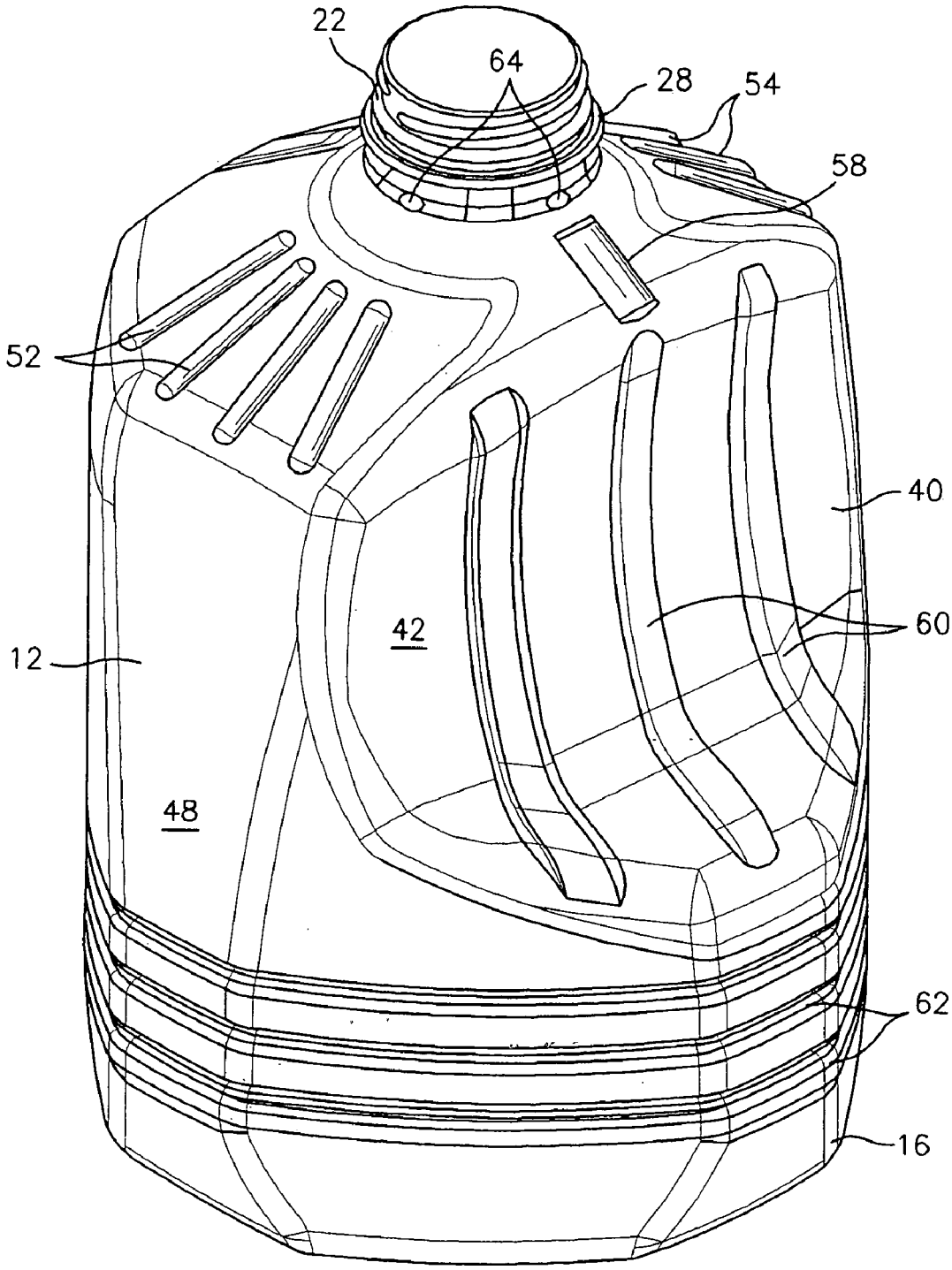
FIG. 5 is a perspective view of the container without handle showing the rear and right side thereof.
Figure 6:
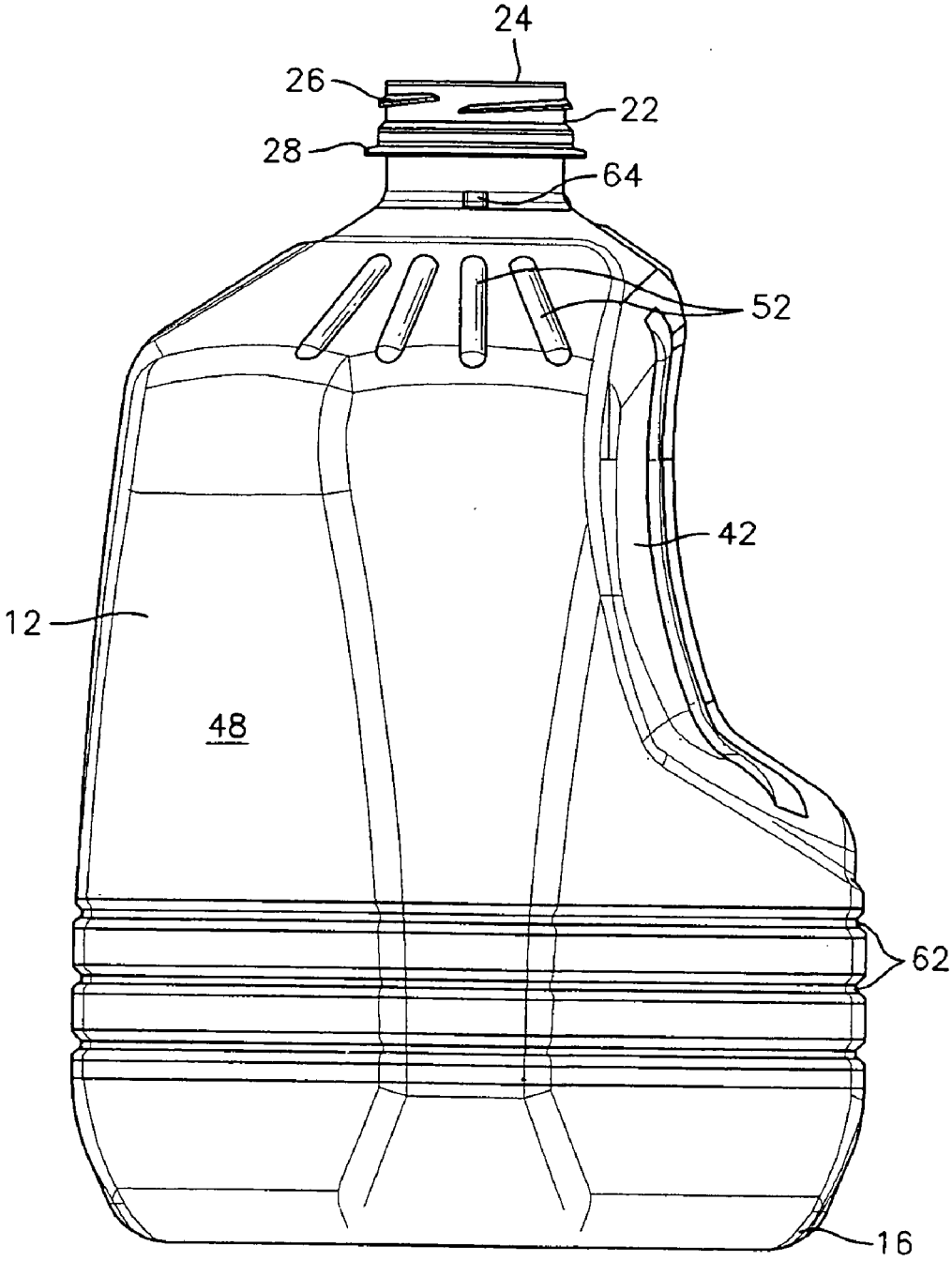
FIG. 6 is a right side view of the container without handle of FIG. 5.

FIGS. 5–6 show container portion 12, without handle 14 attached thereto. Inwardly curved portion 42 of rear sidewall 40 can be clearly seen, along with its three longitudinal ribs 60. Also, right side shoulder ribs 52 and rear shoulder rib 58 can be clearly seen in FIG. 5, and left side shoulder ribs 54 can also be clearly seen in FIG. 5. In addition, FIGS. 5 and 6 show neck portion 22 with outwardly extending projections 64 spaced around the circumference of the neck portion 22 below the outward rim 28. These engage corresponding notches or grooves 66 on the inside surface 68 of annular handle portion 36 as can be clearly seen for example in FIG. 9 which is a perspective view of the open handle 70. Preferably three projections 64 are spaced around the circumference of the neck portion 22 to engage three corresponding grooves 66 on the inside surface 68 of annular handle portion 36 to advantageously prevent rotation of the handle 14 when applied to the container portion 12.

Figure 7:
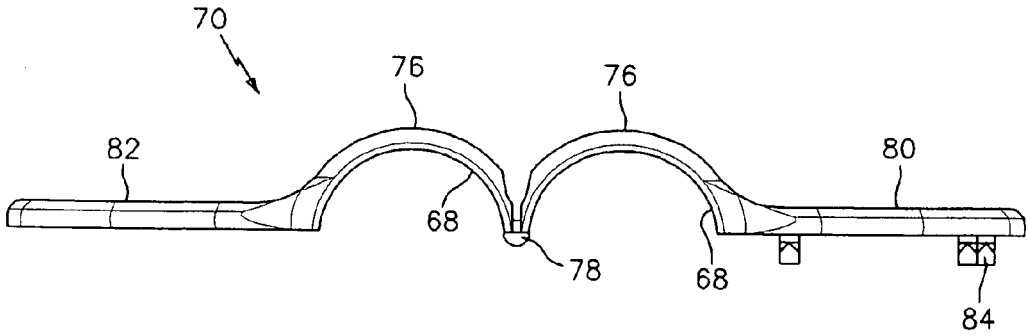
FIG. 7 is a top view of the separately formed handle in the open position.
Figure 8:
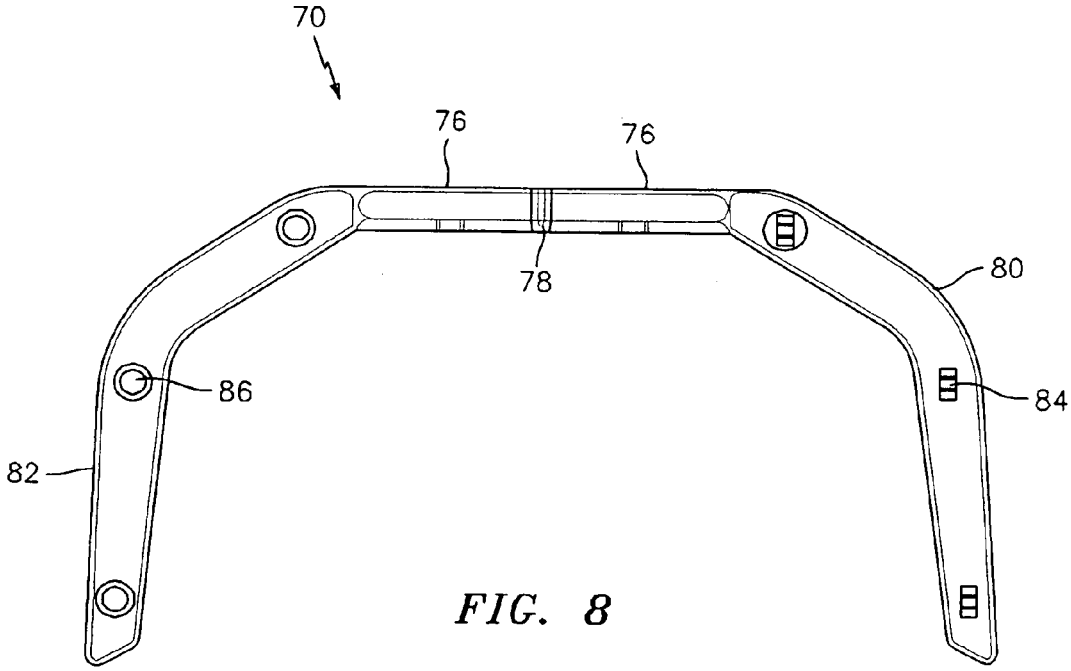
FIG. 8 is a front view of the open handle of FIG. 7.
Figure 9:
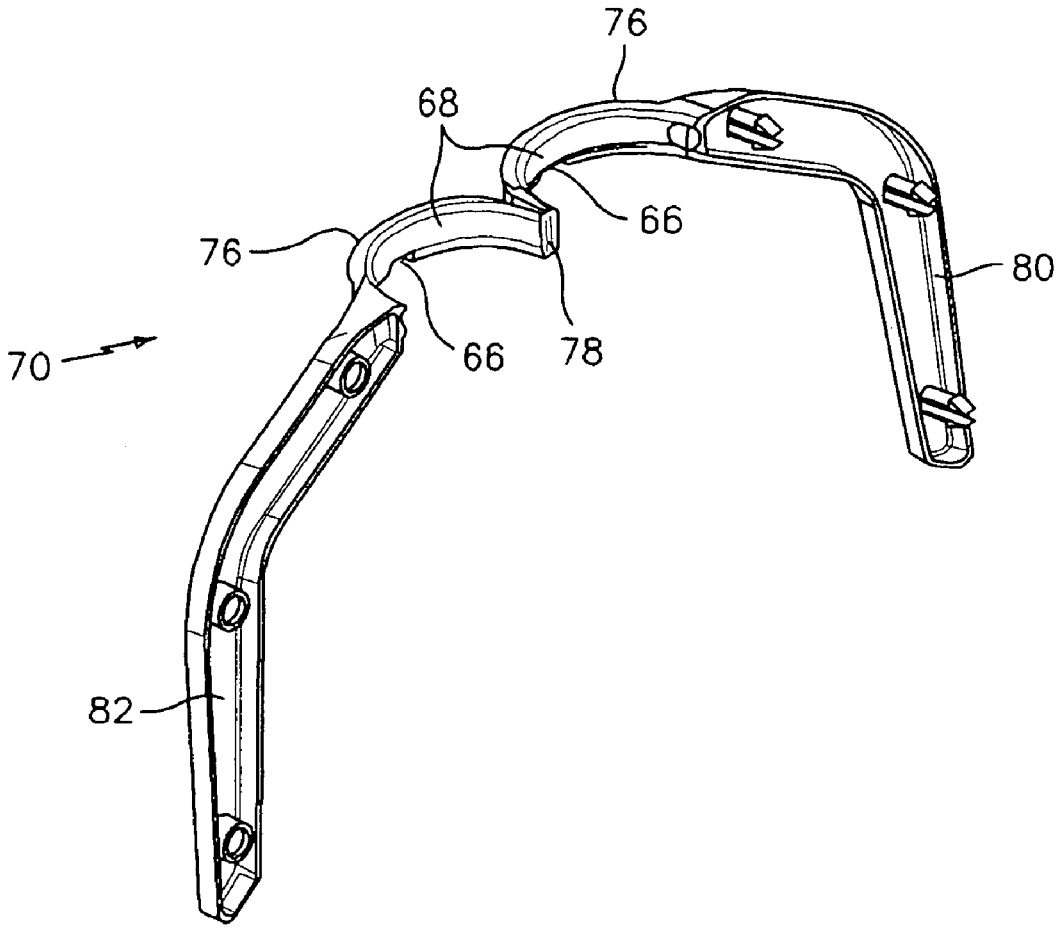
FIG. 9 is a perspective view of the open handle of FIG. 7.
Figure 10:
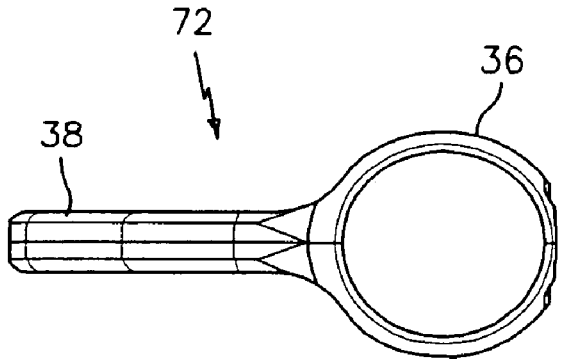
FIG. 10 is a top view of the separately formed handle in the closed position.
Figure 11:
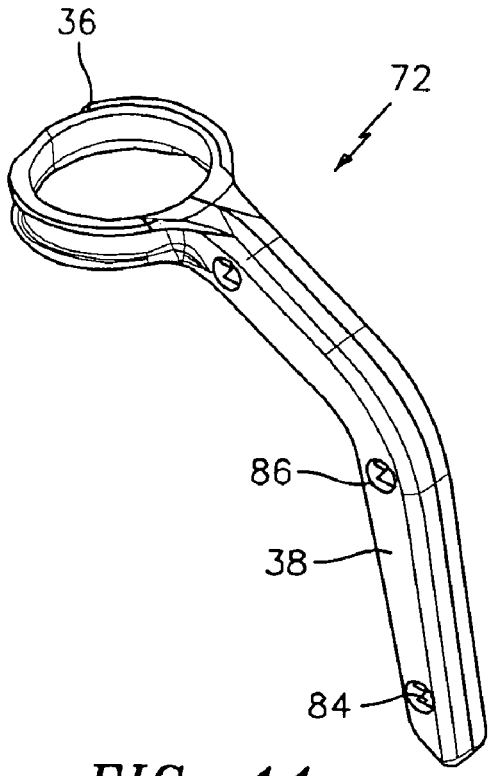
FIG. 11 is a perspective view of the closed handle of FIG. 10.
Figure 12:
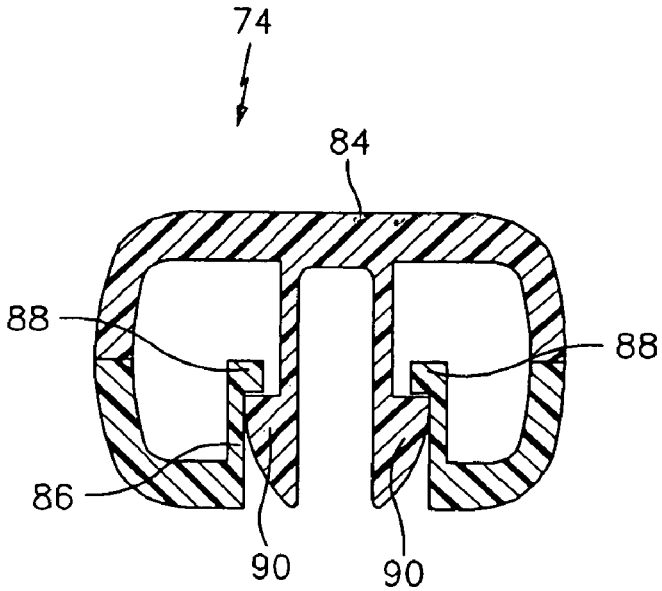
FIG. 12 is a sectional view of the locking section of the handle arms.

FIGS. 7–12 are views of the separately formed handle 14, which is preferably also of plastic material. FIGS. 7, 8 and 9 are top, front and perspective views, respectively of the separately formed open handle 70. FIGS. 10 and 11 are top and perspective views respectively of the closed handle 72, and FIG. 12 is a sectional view of the locking section 74 of the handle arms.

The open handle 70 includes two semi-circular central portions 76 connected together by hinge 78. The semi-circular portions are configured to be wrapped around container neck portion 22 and be snapped together in a positive, locked engagement that permits the handle to be easily closed around the neck portion in a positive locking manner. As previously described, inside surface 68 of semi-circular portions 76 include at least one notch or groove 66 which engage projections 64 on neck portion 22 to prevent handle rotation when the handle is applied to the container neck portion.

In addition, open handle 70 includes arm portions 80, 82 which extend outwardly from semi-circular central portions 76.

In the closed position 72 arm portions 80, 82 are connected together to form a single closed handle 38, and the semi-circular portions 76 are closed together to form annular portion 36 which is configured to engage the neck portion 22 of the container and to be supported thereby, with the grooves or notches 66 engaging projections 64. The arm portions 80, 82 are locked together by a locking mechanism shown in FIG. 12, including at least one and preferably a plurality of pins 84 on one arm engaged in and firmly held by at least one and preferably a plurality of holes 86 in the other arm, with locking tabs 88 on holes 86 interlocked with locking tabs 90 on pins 84. Naturally, other arm locking mechanisms may be employed.

The container of the present invention thus includes a separately formed handle which can be simply and conveniently and firmly affixed to the container portion. The container portion is preferably a lightweight plastic container as PET, that can be optimized for reheat stretch blow molding in conventional blow molding machines in a format that permits a larger number of units to be prepared per cycle. Moreover, the assembled container is consumer friendly, easy to use and presents a stable, desirable final structure.

Naturally, variations within the scope of the present invention are contemplated herein. For example, one may readily alter the handle configuration, and rib reinforcement modifications may be added to facilitate handling performance as required for a particular application.

While the present invention has been particularly shown and described with reference to the foregoing preferred and alternative embodiments, it should be understood by those skilled in the art that various alternatives to the embodiments of the invention described herein may be employed in practicing the invention without departing from the spirit and scope of the invention as defined in the following claims. It is intended that the following claims define the scope of the invention and that all within the scope of these claims and their equivalents be covered thereby. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application.

What is claimed is:

1. Plastic container with a separately formed handle, which comprises:

a hollow body of plastic material having a lower, supporting base, a sidewall extending upwardly from the base, a shoulder portion extending upwardly from the sidewall, and an upper neck portion with an opening therein extending upwardly from the shoulder portion;

a separately formed, unitary, one-piece handle having a first open position and a second closed position, and having an annular portion engaging said neck portion and supported thereby, and a handle portion extending downwardly from the annular portion; and wherein said neck portion and annular portion each include at least two engagement surfaces which fit together to form at least two projections seated in at least two grooves, said first open position having semi-circular central portions connected by a hinge, with said engagement surfaces provided on the semi-circular portions and configured to engage said engagement surfaces on the neck portion, and wherein said second closed position having said semi-circular portions closed to form said annular portion with the engagement surfaces fitted together, and wherein said first open position includes two arm portions extending outwardly from the semi-circular portions and said second closed position includes said two arm portions connected together in a locking engagement to form said handle portion.

2. Plastic container according to claim 1, wherein the separately formed handle is plastic, and wherein the inside surface of the annular portion of the handle includes a plurality of inwardly extending grooves, and the neck portion includes a plurality of outwardly extending projections seated therein.

3. Plastic container according to claim 2, wherein said grooves and projections are spaced around the circumference of said annular portion and neck portion, respectively.

4. Plastic container according to claim 2, wherein the neck portion includes a threaded section and an outwardly extending rim below the threaded section, and wherein the annular portion of the separately formed handle engages the neck portion below said rim.

5. A plastic container according to claim 2, wherein the shoulder portion of said hollow body includes a plurality of spaced apart, downwardly extending, outward ribs.

6. A plastic container according to claim 2, wherein the lower portion of said sidewall includes at least one, inwardly extending rib circumscribing the circumference of said hollow body.

7. A plastic container according to claim 2, wherein said sidewall includes an inwardly curved portion, and wherein said handle portion extends adjacent said inwardly curved portion.

8. A plastic container according to claim 7, wherein said inwardly curved portion includes at least one downwardly extending outward rib.

9. A plastic container according to claim 7, wherein the lower portion of said inwardly curved portion includes an outwardly extending ridge, and wherein the handle portion includes an end portion which is spaced above said ridge.

10. A plastic container according to claim 2, wherein the base of said hollow body includes an inwardly extending portion, a peripheral rim, and a plurality of outward ribs extending between the inwardly extending portion and peripheral rim.

11. Plastic container according to claim 1, wherein said arm portions are secured together by at least one pin on one arm engaged with at least one hole on a second arm in a locking engagement.

12. A handle configured to be attached to a separately formed container, which comprises:

a unitary, one-piece handle having a first open position and a second closed position;

said first open position having semi-circular central portions connected by a hinge and including two arm portions extending outwardly from the semi-circular portions, wherein at least two engagement surfaces are provided on the semi-circular portions configured to engage at least two engagement surfaces on the separately formed container to form at least projections seated in at least two grooves; and said second closed position having said semi-circular portions closed to form an annular portion configured to engage a neck portion of the separately formed container with the engagement surfaces fitted together, and having a handle portion extending from said annular portion, with said second closed position including said two arm portions connected together in a locking engagement to form said handle portion.

13. A handle according to claim 12, including a plurality of inwardly extending grooves on the inside surface of the semi-circular portions configured to engage a plurality of projections on the neck portion of the separately formed container.

14. A handle according to claim 13, wherein said plurality of grooves on said semi-circular portions are spaced around the circumference thereof.

15. A handle according to claim 13, wherein said handle is plastic.

16. A handle according to claim 12, wherein said arm portions are secured together by at least one pin on one arm engaged with at least one hole on a second arm in a locking engagement.

17. A handle according to claim 16, including locking tabs on holes in one arm interlocked with locking tabs on pins on a second arm.

* * * * *